US006514932B1

(12) United States Patent
Hubesch et al.

(10) Patent No.: US 6,514,932 B1
(45) Date of Patent: Feb. 4, 2003

(54) WRINKLE RESISTANT COMPOSITION

(75) Inventors: Bruno Albert Jean Hubesch, Leefdaal (BE); Axel Masschelein, Brussels (BE); Els Goossens, Oppuurs (BE); Markus W. Altmann, Brussels (BE); An Bernaerts, Sint-Katelijne-Waver (BE)

(73) Assignee: Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/762,080

(22) PCT Filed: Aug. 3, 1999

(86) PCT No.: PCT/US99/17554

§ 371 (c)(1),
(2), (4) Date: Feb. 1, 2001

(87) PCT Pub. No.: WO00/08127

PCT Pub. Date: Feb. 17, 2000

(30) Foreign Application Priority Data

Aug. 3, 1998 (EP) ..... 98870173

(51) Int. Cl.[7] ..... C11D 3/37
(52) U.S. Cl. ..... 510/517

(58) Field of Search ..... 510/516, 522, 510/527, 517

(56) References Cited

U.S. PATENT DOCUMENTS

| | | | | | |
|---|---|---|---|---|---|
| 4,255,484 | A | * | 3/1981 | Stevens | 428/286 |
| 4,304,565 | A | * | 12/1981 | Blanchard et al. | 8/471 |
| 4,923,623 | A | | 5/1990 | Coffindaffer | |
| 5,137,646 | A | * | 8/1992 | Schmidt et al. | 252/8.8 |

FOREIGN PATENT DOCUMENTS

| | | | | |
|---|---|---|---|---|
| EP | 300525 | A2 | | 1/1989 |
| EP | 363346 | A2 | | 4/1990 |
| EP | 719856 | A1 | * | 7/1996 |
| EP | 799887 | A1 | * | 10/1997 |
| EP | 978556 | A1 | | 2/2000 |
| WO | WO 92/18601 | | * | 10/1992 |

* cited by examiner

*Primary Examiner*—John Hardee
(74) *Attorney, Agent, or Firm*—C. Brant Cook; K. W. Zerby; Steve W. Miller

(57) ABSTRACT

There is provided a composition as well as a method for treating fabrics in order to improve various properties of fabrics, in particular, wrinkle resistance by means of a cross-linking resin having cationic properties.

10 Claims, No Drawings

WRINKLE RESISTANT COMPOSITION

TECHNICAL FIELD OF THE INVENTION

The present invention relates to fabric care compositions and to a method for treating fabrics in order to improve various properties of fabrics, in particular, wrinkle resistance.

BACKGROUND OF THE INVENTION

The domestic treatment of fabric is a problem known in the art to the formulator of laundry compositions. Hence, It is well known that alternating cycles of using and laundering fabrics and textiles, such as articles of worn clothing and apparel, will inevitably adversely affect the appearance and integrity of the fabric and textile items so used and laundered. Fabrics and textiles simply wear out over time and with use. Laundering of fabrics and textiles is necessary to remove soils and stains which accumulate therein and thereon during ordinary use. However, the laundering operation itself, over many cycles, can accentuate and contribute to the deterioration of the integrity and the appearance of such fabrics and textiles.

One solution for improving the appearance and integrity of the fabric can be found in WO98/04772 which provides the treatment of fabric against fabric creasing by application of a composition comprising a polycarboxylic acid or derivative thereof; and then curing the composition using a domestic process. However, it has been found that, although effective in reducing creasing, the compounds described in this patent still do not effectively bind the cellulosic fibers in rinse application.

Accordingly, it is an object of the invention to provide compound and compositions thereof which provide effective deposition on the fabric without being detrimental to the appearance and integrity of the fabric. In particular, it is an object of the invention to provide compound or compositions having effective durable press properties.

The durable press problem in industrial field is known in the art. Processes for the industrial durable press treatment of textile fabrics were first introduced in the 1960's and have achieved widespread use since that time. These durable press treatment processes typically involve treating the fibers of the textile fabrics with cross-linking agents. Early durable press processes used formaldehyde as a cross-linking agent which, although effective, was highly odorous and undesirable to the consumer.

As a consequence, formaldehyde was replaced by reactive resins such as dimethylol urea (DMU), dimethylol ethylene urea (DMEU), and by modified ethylene urea resins, such as dimethylol dihydroxy ethylene urea (DMDHEU). However, still it is known that the desired increases in the durable press performance through the use of cross-linking agents are sometimes accompanied by undesirable losses in other important fabric properties, such as tensile strength, tear strength, abrasion resistance and fabric hand.

Further, solutions obtained from industry are not usually transposable to domestic treatments. Indeed, in industrial processes a strict control over parameters such as pH, electrolyte concentration, water hardness, temperature, etc.. is possible whereas in a domestic washing machine, such a high level of control is not possible.

Moreover, it has been found that solutions from industry do not effectively bind the cellulosic fibers in domestic rinse application.

Domestic durable press treatments require conditions that industrial treatment do not have to fulfill. Hence, for domestic durable treatments, the compounds or compositions thereof need to manifest at least one of the following properties:

i)—provide a low level of aldehyde; indeed aldehyde based cross-linker technologies are less favoured in domestic process from an environmental and safety standpoint because contrary to industry where the process is controlled, in domestic process the consumer is the only person using the product, thus enabling the possibility of misuse. Further, high levels of aldehyde tends to produce an odour which would deter the consumer from using it again. Thus, it is desired to provide durable processes for use in domestic process which are safe to the consumer and provide a good odour acceptance.

ii)—provide a low or even no tensile strength loss; again as stated above for i), the control of the process in domestic treatment is less measurable. Further, contrary to industry where the fabrics are treated once, domestic treatment involves repeated usage and thus produce a tensile strength loss. Thus, it is desired to provide durable processes for use in domestic process which provide a low or even no tensile strength loss.

iii)—be usable at low temperature; indeed in a domestic process, and in particular in a domestic rinse process, it is not practical to rely on high treatment temperatures such as those used in industrial processes, that is of above 40° C. Thus, it is also a further desire of domestic durable press to provide a better performance at these low temperatures; indeed industry usually achieves a better performance by close control of the reaction process and its various parameters involved. In domestic treatment, however, this close control cannot be achieved. Thus, the performance of the durable press process needs mostly to be achieved by use of efficient technology.

iv)—be applicable in rinse applications: in such type of application, easier control of the use of the product is achieved, thereby avoiding misuse. Thus, for domestic treatment, the technology involved in the durable press process needs preferably to be suitable for use in rinse application. and/or vi)—not provide stiffness to fabrics. Again, as described for ii), the repeated usage that are involved in domestic treatment may also lead to stiff fabric. Accordingly, it is desired to provide durable press process which reduces such negative.

In addition to the above, industrial processes use high concentrations of cross-linking agents which is required for industrial scale treatment whilst for domestic treatment a low level is most preferred for economical reasons.

Accordingly, notwithstanding the advances in the art, there is still a need for an efficient and economical composition which provides effective domestic durable press properties on the treated fabrics.

It has now been found that the use of specific resin compounds fulfill such a need, and are particularly well suited for rinse application.

SUMMARY OF THE INVENTION

The present invention is a composition comprising:

i)—a fabric softening compound; and ii)—a cross-linking resin having the property of being cationic.

In another aspect of the invention, the present invention relates to a method of treating fabric which comprises the steps of:

i)—contacting the fabrics with an epichlorohydrin adducts of polyamine resins, polyethyleneimine resins, cationic starch, polydiallyidimethylammonium chloride, and mixtures thereof, and ii)—curing the composition.

In a further aspect of the invention, the present invention relates to a method of treating fabric which comprises the steps of:

i)—contacting the fabrics with a resin compound or composition as defined herein, and ii)—curing the composition using a domestic process.

DETAILED DESCRIPTION OF THE INVENTION

The present invention relates to compositions which provide effective durable press on treated fabrics, especially when treated in rinse application.

I—Cross-linking Resin having the Property of Being Cationic

An essential component of the invention is a cross-linking resin having the property of being cationic. By "cross-linking resin having the property of being cationic", it is meant that the resin is at least partially positively charged. It is not however necessary that the reactive part of the molecule carries the positive charge. Indeed, polymeric resins can be based on positively charged monomers which help the deposition on the fibers. Since the cross-linking resins are cationic, i.e. positively charged, they are deposited and well retained on the negatively charged cellulosic fibers when these resins are added to the final rinse of a laundry process.

Cross-linking resins having the property of being cationic suitable for use herein are those commonly known as having wet strength in the paper field. At least two mechanisms have been postulated to account for the mechanism by which wet strength resin act. One is that wet strength resins form covalent bonds between adjacent fibers while another is that the wet strength resin places a layer over the hydrogen bonds formed between adjacent paper fibers and thus prevents water from breaking the hydrogen bonds.

Conventional wet-strength agents suitable for use herein include compounds made of epichlorohydrin adducts of polyamines, polyethyleneimines, cationic starches, polydiallyldimethylammonium chloride, and mixtures thereof, amine-aldehyde resins such as melamine-formaldehyde resin, amide-aldehyde resins, and mixtures thereof. For use within the meaning of the present invention, there can also be used materials of the above-mentioned classes of substances which admittedly do not themselves possess any outstanding wet-strength properties but, nevertheless, have the same durable press effect as do the wet-strength agents as described therein.

Among the class of epichlorohydrin adducts of polyamines, polyethyleneimines, cationic starches, polydiallyldimethylammonium chloride, and mixtures thereof, the preferred components are the polymeric amine-epichlorohydrin resins selected from the group consisting of a polyamide-epichlorohydrin (PAE) resin, a polyalkylenepolyamine-epichlorohydrin (PAPAE) resin, and an amine polymer-epichlorohydrin (APE) resin, in which the amine groups have been alkylated with epichlorohydrin to produce a polyamine-epichlorohydrin resin that has azetidinium or epoxide functionality. Preferably, for use herein, the cross-linking resin having cationic properties is a cationic wet strength resin that is produced by reacting a saturated aliphatic dicarboxylic acid containing three to ten carbon atoms with a polyalkylenepolyamine, containing from two to four ethylene groups, two primary amine groups, and one to three secondary amine groups (such as diethylenetriamine, triethylenetetramine and tetraethylenepentamine), to form a poly(aminoamide) having secondary amine groups that are alkylated with epichlorohydrin to form a PAE resin.

These polyamide/polyamine/epichlorohydrin wet-strength resins are fully described by Carr, Doane, Hamerstrand and Hofreiter, in an article appearing in the Journal of Applied Polymer Science Vol. 17, pp. 721–735 (1973). Such resins are available as KYMENE from Hercules, Inc. A commercial synthesis of such resins from adipic acid, diethylene triamine and epichlorohydrin is described in the Carr et al publication, ibid., and is U.S. Pat. No. 2,926,154 (Feb. 23, 1960) to G. I. Keim or U.S. Pat. No. 4,240,995. Reference can be made to these publications for further details regarding the preparation of polyamide/polyamine/epichlorohydrin resins.

Most preferred cross-linking resin having cationic properties from this class are the wet strength resin Kymene 557H (available from Hercules Incorporated), in which adipic acid is reacted with diethylenetriamine to form a poly(aminoamide) that is alkylated and crosslinked with epichlorohydrin to form a PAE resin. Still another preferred cross-linking resin having cationic properties made of epichlorohydrin are Luresin.RTM and Etadurin which both are polyamidoamine-epichlorohydrin resins.

Amine-aldehyde resins are suitable cross-linking resins for the present invention and are made by condensation of amine or amide monomers with aldehydes such as formaldehyde or glyoxal. Preferred amines are those having low molecular weight amines e.g. melamine or polymeric amines e.g. poly-diallylamine, preferably quarternized. Preferred amides are those polymeric amides such as polyacrylamide. All these suitable amine/amide monomers can also be copolymerized with cationic monomers.

Among the class of amine-aldehyde cross-linking resin, preferred are those from the class of melamine-formaldehyde resin. Melamine-formaldehyde resins of this type are known as crosslinking agents of this type in the coating industry and are also described, for example, in German Auslegeschrift Nos. 2,457,387 (U.S. Pat. No. 4,035,213 incorporated herein by reference) and 1,719,324 and, in particular, in U.S. Pat. No. 3,242,230 incorporated herein by reference.

Preferred melamine-formaldehyde resin are those commercially available under the tradenames Madurit, and Cassurit from Clariant.

Still other preferred cross-linking resin having the property of being cationic among the class of amine-aldehyde cross-linking resin are the Poly(acrylamide-glyoxal) resin commercially available under the tradename SOLIDURIT KM from Clariant.

According to the present invention, there can also be used a mixture of wet-strength agents of the above-mentioned types or equivalent compounds.

Preferably for the purpose of the invention, the cross-linking resin having cationic properties have a molecular weight between 200 and 1,000,000, preferably between 500 and 100,000, most preferably between 1000 and 25,000. Cross-linking resin having a low molecular weight are most preferred for use in the present invention as they are more water-soluble and have a better fiber penetration. By low molecular weight it is meant a molecular weight within the range of from 25 to 2000, preferably from 50 to 1000, and more preferably from 50 to 500.

The above cross-linking components may be used in a composition for delivery onto fabric, such as by means of a rinse process.

It is desirable if the level of cross-linking components or derivative thereof is present in an amount of from 0.01% to 60%, preferably from 0.01% to 30% by weight of the total composition It is advantageous for aldehyde containing cross-linking resins if a catalyst is used with compositions of the invention. Preferred catalysts includes organic acids such as citric acid, succinic acid, and tartaric acids, as well as conventional Lewis acid such as $Al\ Cl_3$ or $MgCl_2$, or salts thereof, or mixtures thereof. A typical example of catalyst is the catalyst NKD made of a mixture of salts and organic acid, and commercially available from Hoechst.

It is preferred if the level of catalyst is from 10% to 50%, preferably from 20 to 40% by weight of the cross-linking components or derivative thereof.

For other cross-linking resins like the Kymene, the use of a catalyst is not necessary.

Fabric Softening Compound

The composition of the invention also contains a fabric softening compound. Typical levels of incorporation of the softening compound in the composition are of from 1% to 80% by weight, preferably from 2% to 70%, more preferably from 5% to 60%, by weight of the composition.

Typical of the cationic softening components are the quaternary ammonium compounds or amine precursors thereof as defined hereinafter.

A)-Quaternary Ammonium Fabric Softening Active Compound (1) Preferred Quaternary Ammonium Fabric Softening Active Compound have the Formula (1)

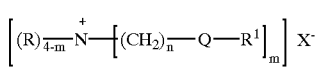

or the formula:

(2)

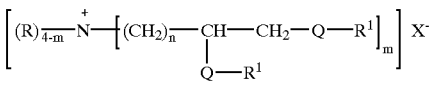

wherein Q is a carbonyl unit having the formula:

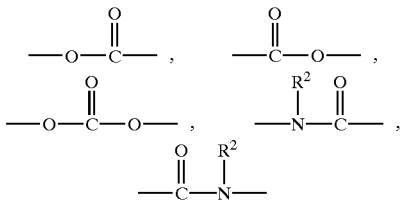

each R unit is independently hydrogen, $C_1$–$C_6$ alkyl, $C_1$–$C_6$ hydroxyalkyl, and mixtures thereof, preferably methyl or hydroxy alkyl; each $R^1$ unit is independently linear or branched $C_{11}$–$C_{22}$ alkyl, linear or branched $C_{11}$–$C_{22}$ alkenyl, and mixtures thereof, $R^2$ is hydrogen, $C_1$–$C_4$ alkyl, $C_1$–$C_4$ hydroxyalkyl, and mixtures thereof; X is an anion which is compatible with fabric softener actives and adjunct ingredients; the index m is from 1 to 4, preferably 2; the index n is from 1 to 4, preferably 2.

An example of a preferred fabric softener active is a mixture of quaternized amines having the formula:

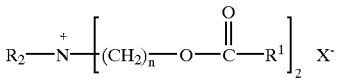

wherein R is preferably methyl; $R^1$ is a linear or branched alkyl or alkenyl chain comprising at least 11 atoms, preferably at least 15 atoms. In the above fabric softener example, the unit $—O_2CR^1$ represents a fatty acyl unit which is typically derived from a triglyceride source. The triglyceride source is preferably derived from tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures of these oils.

The preferred fabric softening actives of the present invention are the Diester and/or Diamide Quaternary Ammonium (DEQA) compounds, the diesters and diamides having the formula:

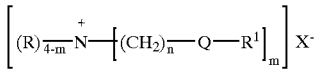

wherein R, $R^1$, X, and n are the same as defined herein above for formulas (1) and (2), and Q has the formula:

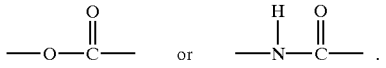

These preferred fabric softening actives are formed from the reaction of an amine with a fatty acyl unit to form an amine intermediate having the formula:

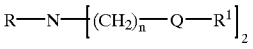

wherein R is preferably methyl, Q and $R^1$ are as defined herein before; followed by quaternization to the final softener active.

Non-limiting examples of preferred amines which are used to form the DEQA fabric softening actives according to the present invention include methyl bis(2-hydroxyethyl) amine having the formula:

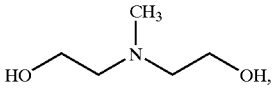

methyl bis(2-hydroxypropyl)amine having the formula:

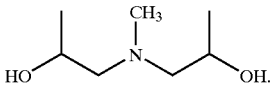

methyl (3-aminopropyl) (2-hydroxyethyl)amine having the formula:

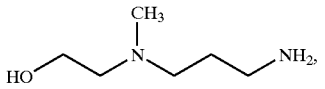

methyl bis(2-aminoethyl)amine having the formula:

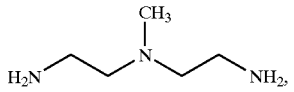

triethanol amine having the formula:

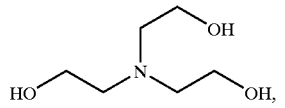

di(2-aminoethyl) ethanolamine having the formula:

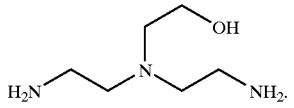

The counterion, $X^{(-)}$ above, can be any softener-compatible anion, preferably the anion of a strong acid, for example, chloride, bromide, methylsulfate, ethylsulfate, sulfate, nitrate and the like, more preferably chloride or methyl sulfate. The anion can also, but less preferably, carry a double charge in which case $X^{(-)}$ represents half a group.

Tallow and canola oil are convenient and inexpensive sources of fatty acyl units which are suitable for use in the present invention as $R^1$ units. The following are non-limiting examples of quaternary ammonium compounds suitable for use in the compositions of the present invention. The term "tallowyl" as used herein below indicates the $R^1$ unit is derived from a tallow triglyceride source and is a mixture of fatty alkyl or alkenyl units. Likewise, the use of the term canolyl refers to a mixture of fatty alkyl or alkenyl units derived from canola oil.

In the following table are described non-limiting examples of suitable fabric softener according to the above formula. In this list, the term "oxy" defines a

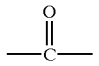

unit, whereas the term "oxo" defines a —O— unit.

Table II

Fabric Softener Actives

N,N-di(tallowyl-oxy-2-oxo-ethyl)-N-methyl, N-(2-hydroxyethyl) ammonium chloride;

N,N-di(canolyl-oxy-2-oxo-ethyl)-N-methyl, N-(2-hydroxyethyl) ammonium chloride;

N,N-di(tallowyloxy-2-oxo-ethyl)-N,N-dimethyl ammonium chloride;

N,N-di(canolyloxy-2-oxo-ethyl)-N,N-dimethyl ammonium chloride

N,N,N-tri(tallowyl-oxy-2-oxo-ethyl)-N-methyl ammonium chloride;

N,N,N-tri(canolyl-oxy-2-oxo-ethyl)-N-methyl ammonium chloride;

N-(tallowyloxy-2-oxo-ethyl)-N-(tallowyl)-N,N-dimethyl ammonium chloride;

N-(canolyloxy-2-oxo-ethyl)-N-(canolyl)-N,N-dimethyl ammonium chloride;

1,2-di(tallowyloxy-oxo)-3-N,N,N-trimethylammoniopropane chloride; and 1,2-di(canolyloxy-oxo)-3-N,N,N-trimethylammoniopropane chloride; and mixtures of the above actives.

Other examples of quaternay ammoniun softening compounds are methylbis(tallowamidoethyl)(2-hydroxyethyl) ammonium methylsulfate and methylbis(hydrogenated tallowamidoethyl)(2-hydroxyethyl)ammonium methylsulfate; these materials are available from Witco Chemical Company under the trade names Varisoft® 222 and Varisoft® 110, respectively.

Particularly preferred is N,N-di(tallowyl-oxy-2-oxo-ethyl)N-methyl, N-(2-hydroxyethyl) ammonium chloride, where the tallow chains are at least partially unsaturated.

The level of unsaturation contained within the tallow, canola, or other fatty acyl unit chain can be measured by the Iodine Value (IV) of the corresponding fatty acid, which in the present case should preferably be in the range of from 5 to 100 with two categories of compounds being distinguished, having a IV below or above 25.

Indeed, for compounds having the formula:

$$\left[(R)_{4-m}\overset{+}{N}-\left[(CH_2)_n-Q-R^1\right]_m\right]X^-$$

derived from tallow fatty acids, when the Iodine Value is from 5 to 25, preferably 15 to 20, it has been found that a cis/trans isomer weight ratio greater than about 30/70, preferably greater than about 50/50 and more preferably greater than about 70/30 provides optimal concentrability.

For compounds of this type made from tallow fatty acids having a Iodine Value of above 25, the ratio of cis to trans isomers has been found to be less critical unless very high concentrations are needed.

Other suitable examples of fabric softener actives are derived from fatty acyl groups wherein the terms "tallowyl" and canolyl" in the above examples are replaced by the terms "cocoyl, palmyl, lauryl, oleyl, ricinoleyl, stearyl, palmityl," which correspond to the triglyceride source from which the fatty acyl units are derived. These alternative fatty acyl sources can comprise either fully saturated, or preferably at least partly unsaturated chains.

As described herein before, R units are preferably methyl, however, suitable fabric softener actives are described by replacing the term "methyl" in the above examples in Table II with the units "ethyl, ethoxy, propyl, propoxy, isopropyl, butyl, isobutyl and t-butyl.

The counter ion, X, in the examples of Table II can be suitably replaced by bromide, methylsulfate, formate, sulfate, nitrate, and mixtures thereof. In fact, the anion, X, is merely present as a counterion of the positively charged quaternary ammonium compounds. The scope of this invention is not considered limited to any particular anion.

For the preceding ester fabric softening agents, the pH of the compositions herein is an important parameter of the present invention. Indeed, it influences the stability of the quaternary ammonium or amine precursors compounds, especially in prolonged storage conditions.

As used herein, when the diester is specified, it will include the monoester that is normally present in manufacture. For softening, under no/low detergent carry-over laundry conditions the percentage of monoester should be as low as possible, preferably no more than about 2.5%. However, under high detergent carry-over conditions, some monoester is preferred. The overall ratios of diester to monoester are from about 100:1 to about 2:1, preferably from about 50:1 to about 5:1, more preferably from about 13:1 to about 8:1. Under high detergent carry-over conditions, the di/monoester ratio is preferably about 11:1. The level of monoester present can be controlled in the manufacturing of the softener compound.

Mixtures of actives of formula (1) and (2) may also be prepared.

2)—Still other suitable quaternary ammonium fabric softening compounds for use herein are cationic nitrogenous salts having two or more long chain acyclic aliphatic $C_8$–$C_{22}$ hydrocarbon groups or one said group and an arylalkyl group which can be used either alone or as part of a mixture are selected from the group consisting of:

(i) acyclic quaternary ammonium salts having the formula:

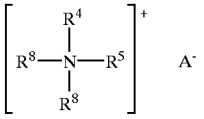

wherein $R^4$ is an acyclic aliphatic $C_8$–$C_{22}$ hydrocarbon group, $R^5$ is a $C_1$–$C_4$ saturated alkyl or hydroxyalkyl group, $R^8$ is selected from the group consisting of $R^4$ and $R^5$ groups, and A–is an anion defined as above;

(ii) diamino alkoxylated quaternary ammonium salts having the formula:

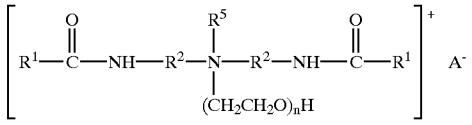

wherein n is equal to 1 to about 5, and $R^1$, $R^2$, $R^5$ and $A^-$ are as defined above;

(iii) mixtures thereof

Examples of the above class cationic nitrogenous salts are the well-known dialkyldimethylammonium salts such as ditallowdimethylammonium chloride, ditallowdimethylammonium methylsulfate, di(hydrogenatedtallow) dimethylammonium chloride, distearyldimethylammonium chloride, dibehenyldimethylammonium chloride. Di(hydrogenatedtallow)di methylammonium chloride and ditallowdimethylammonium chloride are preferred. Examples of commercially available dialkyldimethyl ammonium salts usable in the present invention are di(hydrogenatedtallow)dimethylammonium chloride (trade name Adogen® 442), ditallowdimethylammonium chloride (trade name Adogen® 470, Praepagen® 3445), distearyl dimethylammonium chloride (trade name Arosurf® TA-100), all available from Witco Chemical Company. Dibehenyldimethylammonium chloride is sold under the trade name Kemamine Q-2802C by Humko Chemical Division of Witco Chemical Corporation. Dimethylstearylbenzyl ammonium chloride is sold under the trade names Varisoft ® SDC by Witco Chemical Company and Ammonyx® 490 by Onyx Chemical Company.

B)—Amine Fabric Softening Active Compound

Suitable amine fabric softening compounds for use herein, which may be in amine form or cationic form are selected from:

(i)—Reaction products of higher fatty acids with a polyamine selected from the group consisting of hydroxyalkylalkylenediamines and dialkylenetriamines and mixtures thereof. These reaction products are mixtures of several compounds in view of the multi-functional structure of the polyamines.

The preferred Component (i) is a nitrogenous compound selected from the group consisting of the reaction product mixtures or some selected components of the mixtures.

One preferred component (i) is a compound selected from the group consisting of substituted imidazoline compounds having the formula:

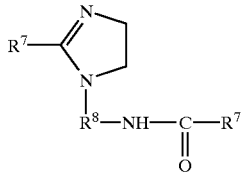

wherein $R^7$ is an acyclic aliphatic $C_{15}$–$C_{21}$ hydrocarbon group and $R^8$ is a divalent $C_1$–$C_3$ alkylene group.

Component (i) materials are commercially available as: Mazamide® 6, sold by Mazer Chemicals, or Ceranine® HC, sold by Sandoz Colors & Chemicals; stearic hydroxyethyl imidazoline sold under the trade names of Alkazine® ST by Alkaril Chemicals, Inc., or Schercozoline® S by Scher Chemicals, Inc.; N,N"-ditallowalkoyldiethylenetriamine; 1-tallowamidoethyl-2-tallowimidazoline (wherein in the preceding structure $R^1$ is an aliphatic $C_{15}$–$C_{17}$ hydrocarbon group and $R^8$ is a divalent ethylene group).

Both N,N"-ditallowalkoyldiethylenetriamine and 1-tallow(amidoethyl)-2-tallowimidazoline are reaction products of tallow fatty acids and diethylenetriamine, and are precursors of the cationic fabric softening agent methyl-1-tallowamidoethyl-2-tallowimidazolinium methylsulfate (see "Cationic Surface Active Agents as Fabric Softeners," R. R. Egan, Journal of the American Oil Chemicals' Society, January 1978, pages 118-121). N,N"-ditallow alkoyldiethylenetriamine and 1-tallowamidoethyl-2-tallowimidazoline can be obtained from Witco Chemical Company as experimental chemicals. Methyl-1-tallowamidoethyl-2-tallowimidazolinium methylsulfate is sold by Witco Chemical Company under the tradename Varisoft® 475.

(ii)—softener having the formula:

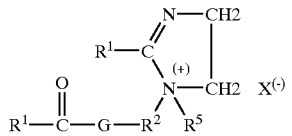

wherein each $R^2$ is a $C_{1-6}$ alkylene group, preferably an ethylene group; and G is an oxygen atom or an —NR— group; and each R, $R^1$, $R^2$ and $R^5$ have the definitions given above and $A^-$ has the definitions given above for $X^-$. An example of Compound (ii) is 1-oleylamidoethyl-2-oleylimidazolinium chloride wherein $R^1$ is an acyclic aliphatic $C_{15}$–$C_{17}$ hydrocarbon group, $R^2$ is an ethylene group, G is a NH group, $R^5$ is a methyl group and $A^-$ is a chloride anion.

(iii)—softener having the formula:

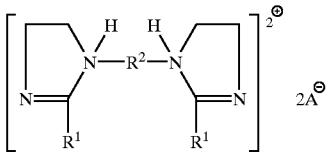

wherein R, $R^1$, $R^2$, and $A^-$ are defined as above.

An example of Compound (iii) is the compound having the formula:

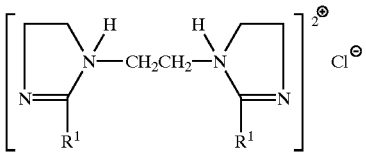

wherein $R^1$ is derived from oleic acid.

Additional fabric softening agents useful herein are described in U.S. Pat. No. 4,661,269, issued Apr. 28, 1987, in the names of Toan Trinh, Errol H. Wahl, Donald M. Swartley, and Ronald L. Hemingway; U.S. Pat. No. 4,439,335, Burns, issued Mar. 27, 1984; and in U.S. Pat. No. : 3,861,870, Edwards and Diehl; U.S. Pat. No. 4,308,151, Cambre; U.S. Pat. No. 3,886,075, Bernardino; U.S. Pat. No. 4,233,164, Davis; U.S. Pat. No. 4,401,578, Verbruggen; U.S. Pat. No. 3,974,076, Wiersema and Rieke; U.S. Pat. No. 4,237,016, Rudkin, Clint, and Young; and European Patent Application publication No. 472,178, by Yamamura et al., all of said documents being incorporated herein by reference.

Of course, the term "softening active" can also encompass mixed softening active agents. Preferred among the classes of softener compounds disclosed herein before are the diester or diamido quaternary ammonium fabric softening active compound (DEQA).

Fully formulated fabric softening compositions may contain, in addition to the hereinbefore described components, one or more of the following ingredients.

Optional Ingredients (1)Liquid Carrier

Another optional, but preferred, ingredient is a liquid carrier. The liquid carrier employed in the instant compositions is preferably at least primarily water due to its low cost, relative availability, safety, and environmental compatibility. The level of water in the liquid carrier is preferably at least about 50%, most preferably at least about 60%, by weight of the carrier. Mixtures of water and low molecular weight, e.g., <about 200, organic solvent, e.g., lower alcohols such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

(2) Dispersibility Aids

Relatively concentrated compositions containing both saturated and unsaturated diester quaternary ammonium compounds can be prepared that are stable without the addition of concentration aids. However, the compositions of the present invention may require organic and/or inorganic concentration aids to go to even higher concentrations and/or to meet higher stability standards depending on the other ingredients. These concentration aids which typically can be viscosity modifiers may be needed, or preferred, for ensuring stability under extreme conditions when particular softener active levels are used. The surfactant concentration aids are typically selected from the group consisting of (1) single long chain alkyl cationic surfactants; (2) nonionic surfactants; (3) amine oxides; (4) fatty acids; and (5) mixtures thereof. These aids are described in WO 94/20597, specifically on page 14, line 12 to page 20, line 12, which is herein incorporated by reference.

When said dispersibility aids are present, the total level is from 0.1% to 20%, preferably from 0.2% to 10%, more preferably from 0.5% to 5%, and even more preferably from 1% to 2% by weight of the composition. These materials can either be added as part of the active softener raw material, (I), e.g., the mono-long chain alkyl cationic surfactant and/or the fatty acid which are reactants used to form the biodegradable fabric softener active as discussed hereinbefore, or added as a separate component. The total level of dispersibility aid includes any amount that may be present as part of component (I).

Inorganic viscosity/dispersibility control agents which can also act like or augment the effect of the surfactant concentration aids, include water-soluble, ionizable salts which can also optionally be incorporated into the compositions of the present invention. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 20,000 parts per million (ppm), preferably from about 20 to about 11,000 ppm, by weight of the composition.

Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and may improve softness performance. These agents may stabilize the viscosity over a broader range of temperature, especially at low temperatures, compared to the inorganic electrolytes.

Specific examples of alkylene polyammonium salts include I-lysine monohydrochloride and 1,5-diammonium 2-methyl pentane dihydrochloride.

(3)-Stabilizers

Stabilizers can be present in the compositions of the present invention. The term "stabilizer," as used herein, includes antioxidants and reductive agents. These agents are present at a level of from 0% to about 2%, preferably from about 0.01% to about 0.2%, more preferably from about 0.035% to about 0.1% for antioxidants, and more preferably from about 0.01% to about 0.2% for reductive agents. These assure good odor stability under long term storage conditions for the compositions and compounds stored in molten form. The use of antioxidants and reductive agent stabilizers is especially critical for low scent products (low perfume).

Examples of antioxidants that can be added to the compositions of this invention include a mixture of ascorbic acid, ascorbic palmitate, propyl gallate, available from Eastman Chemical Products, Inc., under the trade names Tenox® PG and Tenox S-1; a mixture of BHT (butylated hydroxytoluene), BHA (butylated hydroxyanisole), propyl gallate, and citric acid, available from Eastman Chemical Products, Inc., under the trade name Tenox-6; butylated hydroxytoluene, available from UOP Process Division under the trade name Sustane® BHT; tertiary butylhydroquinone, Eastman Chemical Products, Inc., as Tenox TBHQ; natural tocopherols, Eastman Chemical Products, Inc., as Tenox GT-1/GT-2; and butylated hydroxyanisole, Eastman Chemical Products, Inc., as BHA; long chain esters ($C8–C_{22}$) of gallic acid, e.g., dodecyl gallate; Irganox® 1010; Irganox® 1035; Irganox® B 1171; Irganox® 1425; Irganox® 3114; Irganox® 3125; and mixtures thereof; preferably Irganox® 3125, Irganox® 1425, Irganox° 3114, and mixtures thereof; more preferably Irganox® 3125 alone. The chemical names and CAS numbers for some of the above stabilizers are listed in Table II below.

TABLE II

| Antioxidant | CAS. No. | Chemical Name used in Code of Federal Regulations |
|---|---|---|
| Irganox ® 1010 | 6683-19-8 | Tetrakis(methylene(3,5-di-tert-butyl-4 hydroxyhydrocinnamate))methane |
| Irganox ® 1035 | 41484-35-9 | Thiodiethylene bis(3,5-di-tert-butyl-4-hydroxyhydrocinnamate |
| Irganox ® 1098 | 23128-74-7 | N,N'-Hexamethylene bis(3,5-di-tert-butyl-4-hydroxyhydrocinnamamide |
| Irganox ® | 31570-04-4 | |
| B 1171 | 23128-74-7 | 1:1 Blend of Irganox ® 1098 and Irgafos ® 168 |
| Irganox ® 1425 | 65140-91-2 | Calcium bis(monoethyl(3,5-di-tert-butyl-4-hydroxybenzyl)phosphonate) |
| Irganox ® 3114 | 65140-91-2 | Calcium bis(monoethyl(3,5-di-tert-butyl-4-hydroxybenzyl)phosphonate) |
| Irganox ® 3125 | 34137-09-2 | 3,5-Di-tert-butyl-4-hydroxy-hydrocinnamic acid triester with 1,3,5-tris(2-hydroxyethyl)-S-triazine-2,4,6-(1H,3H,5H)-trione |
| Irgafos ® 168 | 31570-04-4 | Tris(2,4-di-tert-butyl-phenyl)phosphite |

Examples of reductive agents include sodium borohydride, hypophosphorous acid, Irgafos® 168, and mixtures thereof.

4- Antimicrobial Active

The composition may suitably use an optional solubilized, water-soluble antimicrobial active, useful in providing protection against organisms that become attached to the treated material. The free, uncomplexed antimicrobial, e.g., antibacterial, active provides an optimum antibacterial performance.

Sanitization of fabrics can be achieved by the compositions of the present invention containing, antimicrobial materials, e.g., antibacterial halogenated compounds, quaternary compounds, and phenolic compounds.

Biguanides. Some of the more robust antimicrobial halogenated compounds which can function as disinfectants/sanitizers as well as finish product preservatives (vide infra), and are useful in the compositions of the present invention include 1,1'-hexamethylene bis(5-(p-chlorophenyl) biguanide), commonly known as chlorhexidine, and its salts, e.g., with hydrochloric, acetic and gluconic acids. The digluconate salt is highly water-soluble, about 70% in water, and the diacetate salt has a solubility of about 1.8% in water. When chlorhexidine is used as a sanitizer in the present invention it is typically present at a level of from about 0.001% to about 0.4%, preferably from about 0.002% to about 0.3%, and more preferably from about 0.01% to about 0.1%, by weight of the usage composition. In some cases, a level of from about 1% to about 2% may be needed for virucidal activity.

Other useful biguanide compounds include Cosmoci® CQ®, Vantocil® IB, including poly (hexamethylene biguanide) hydrochloride. Other useful cationic antimicrobial agents include the bis-biguanide alkanes. Usable water soluble salts of the above are chlorides, bromides, sulfates, alkyl sulfonates such as methyl sulfonate and ethyl sulfonate, phenylsulfonates such as p-methylphenyl sulfonates, nitrates, acetates, gluconates, and the like.

As stated hereinbefore, the bis biguanide of choice is chlorhexidine and its salts, e.g., digluconate, dihydrochloride, diacetate, and mixtures thereof.

Quaternary Compounds. A wide range of quaternary compounds can also be used as antimicrobial actives, in conjunction with the preferred surfactants, for compositions of the present invention that do not contain cyclodextrin. Non-limiting examples of useful quaternary compounds include: (1) benzalkonium chlorides and/or substituted benzalkonium chlorides such as commercially available Barquat® (available from Lonza), Maquat® (available from Mason), Variquat® (available from Witco/Sherex), and Hyamine® (available from Lonza); (2) dialkyl quaternary such as Bardac® products of Lonza, (3) N-(3-chloroallyl) hexaminium chlorides such as Dowicide® and Dowicil® available from Dow; (4) benzethonium chloride such as Hyamine® 1622 from Rohm & Haas; (5) methylbenzethonium chloride represented by Hyamine® 10×supplied by Rohm & Haas, (6) cetylpyridinium chloride such as Cepacol chloride available from of Merrell Labs. Typical concentrations for biocidal effectiveness of these quaternary compounds range from about 0.001% to about 0.8%, preferably from about 0.005% to about 0.3%, more preferably from about 0.01% to 0.2%, by weight of the usage composition. The corresponding concentrations for the concentrated compositions are from about 0.003% to about 2%, preferably from about 0.006% to about 1.2%, and more preferably from about 0.1% to about 0.8% by weight of the concentrated compositions.

Other preservatives which are conventional in the art, such as described in U.S. Pat. No. 35 5,593,670 incorporated herein by reference, may also be used herein.

5-Perfume

The present invention can contain a perfume. Suitable perfumes are disclosed in U.S. Pat. No. 5,500,138, said patent being incorporated herein by reference.

As used herein, perfume includes fragrant substance or mixture of substances including natural (i.e., obtained by extraction of flowers, herbs, leaves, roots, barks, wood, blossoms or plants), artificial (i.e., a mixture of different nature oils or oil constituents) and synthetic (i.e., synthetically produced) odoriferous substances. Such materials are often accompanied by auxiliary materials, such as fixatives, extenders, stabilizers and solvents. These auxiliaries are also included within the meaning of "perfume", as used herein. Typically, perfumes are complex mixtures of a plurality of organic compounds.

Examples of perfume ingredients useful in the perfumes of the present invention compositions include, but are not limited to, hexyl cinnamic aldehyde; amyl cinnamic aldehyde; amyl salicylate; hexyl salicylate; terpineol; 3,7-dimethyl-cis-2,6-octadien-1-ol; 2,6-dimethyl-2-octanol; 2,6-dimethyl-7-octen-2-ol; 3,7-dimethyl-3-octanol; 3,7-dimethyl-trans-2,6-octadien-1-ol; 3,7-dimethyl-6-octen-1-ol; 3,7-dimethyl-1 -octanol; 2-methyl-3-(para-tert-butylphenyl)-propionaldehyde; 4-(4-hydroxy 4-methylpentyl)-3-cyclohexene-1 -carboxaldehyde; tricyclodecenyl propionate; tricyclodecenyl acetate; anisaldehyde; 2-methyl-2-(para-iso-propylphenyl)-propionaldehyde; ethyl-3-methyl-3-phenyl glycidate; 4-(para-hydroxyphenyl)-butan-2-one; 1-(2,6,6-trimethyl-2-cyclohexen-1-yl)-2-buten-1-one; para-methoxyacetophenone; para-methoxy-alpha-phenylpropene; methyl-2-n-hexyl-3-oxo-cyclopentane carboxylate; undecalactone gamma.

Additional examples of fragrance materials include, but are not limited to, orange oil: lemon oil; grapefruit oil; bergamot oil; clove oil; dodecalactone gamma; methyl-2-(2-pentyl-3-oxo-cyclopentyl) acetate; beta-naphthol methyl-ether; methyl-beta-naphthylketone; coumarin; decylaldehyde; benzaldehyde; 4-tert-butylcyclohexyl acetate; alpha, alpha-dimethylphenethyl acetate; methylphenylcarbinyl acetate; Schiffs base of 4-(4-hydroxy-4-methylpentyl)3-cyclohexene-l-carboxaldehyde and methyl anthranilate; cyclic ethyleneglycol diester of tridecandioic acid; 3,7-dimethyl-2,6-octadiene-1-nitrile; ionone gamma methyl; ionone alpha; ionone beta; petitgrain; methyl cedrylone; 7-acetyl-1,2,3,4,5,6,7,8-octahydro-1,1,6,7-tetramethyl-naphthalene; ionone methyl; methyl-1,6,10-trimethyl-2,5,9-cyclododecatrien-1-yl ketone; 7-acetyl-1,1,3,4,4,6-hexamethyl tetralin; 4-acetyl-6-tert-butyl-1,1-dimethyl indane; benzophenone; 6-acetyl-1,1,2,3,3,5-hexamethyl indane; 5-acetyl-3-isopropyl-1,1,2,6-tetramethyl indane; 1-dodecanal; 7-hydroxy-3,7-dimethyl octanal; 10-undecen-1-al; iso-hexenyl cyclohexyl carboxaldehyde; formyl tricyclodecan; cyclopentadecanolide; 16-hydroxy-9-hexadecenoic acid lactone; 1,3,4,6,7,8-hexahydro4,6,6,7,8,8-hexamethylcyclopenta-gamma-2-benzopyrane; ambroxane; dodecahydro-3a,6,6,9a-tetramethylnaphtho-[2,1 b]furan; cedrol; 5-(2,2,3-trimethylcyclopent-3-enyl)-3-methylpentan-2-ol; 2-ethyl-4-(2,2,3-trimethyl-3-cyclopenten-1-yl)-2-buten-1-ol; caryophyllene alcohol; cedryl acetate; para-tert-butylcyclohexyl acetate; patchouli; olibanum resinoid; labdanum; vetivert; copaiba balsam; fir balsam; and condensation products of: hydroxycitronellal and methyl anthranilate; hydroxycitronellal and indol; phenyl acetaldehyde and indol; 4-(4-hydroxy-4-methyl pentyl3-cyclohexene-l-carboxaldehyde and methyl anthranilate.

More examples of perfume components are geraniol; geranyl acetate; linalool; linalyl acetate; tetrahydrolinalool; citronellol; citronellyl acetate; dihydromyrcenol; dihydromyrcenyl acetate; tetrahydromyrcenol; terpinyl acetate; nopol; nopyl acetate; 2-phenylethanol; 2-phenylethyl acetate; benzyl alcohol; benzyl acetate; benzyl salicylate; benzyl benzoate; styrallyl acetate; dimethylbenzylcarbinol; trichloromethylphenylcarbinyl methylphenylcarbinyl acetate; isononyl acetate; vetiveryl acetate; vetiverol; 2-methyl-3-(p-tert-butylphenyl)propanal; 2-methyl-3-(p-isopropylphenyl)-propanal; 3-(p-tert-butylphenyl)propanal; 4-(4-methyl-3-pentenyl)-3-cyclohexenecarbaldehyde; 4-acetoxy-3-pentyltetrahydropyran; methyl dihydrojasmonate; 2-n-heptylcyclopentanone; 3-methyl-2-pentyl-cyclopentanone; n-decanal; n-dodecanal; 9-decenol-1; phenoxyethyl isobutyrate; phenylacetaldehyde dimethylacetal; phenylacetaldehyde diethylacetal; geranonitrile; citronellonitrile; cedryl acetal; 3-isocamphylcyclohexanol; cedryl methylether; isolongifolanone; aubepine nitrile; aubepine; heliotropine; eugenol; vanillin; diphenyl oxide; hydroxycitronellal ionones; methyl ionones; isomethyl ionomes; irones; cis-3-hexenol and esters thereof; indane musk fragrances; tetralin musk fragrances; isochroman musk fragrances; macrocyclic ketones; macrolactone musk fragrances; ethylene brassylate.

The perfumes useful in the present invention compositions are substantially free of halogenated materials and nitromusks.

Suitable solvents, diluents or carriers for perfumes ingredients mentioned above are for examples, ethanol, isopropanol, diethylene glycol, monoethyl ether, dipropylene glycol, diethyl phthalate, triethyl citrate, etc. The amount of such solvents, diluents or carriers incorporated in the perfumes is preferably kept to the minimum needed to provide a homogeneous perfume solution.

Perfume can be present at a level of from 0% to 10%, preferably from 0.1% to 5%, and more preferably from 0.2% to 3%, by weight of the finished composition. Fabric softener compositions of the present invention provide improved fabric perfume deposition.

Perfume ingredients may also be suitably added as releasable fragrances, for example, as pro-perfumes or pro-fragrances as described in U.S. Pat. No. 5,652,205 Hartman et al., issued Jul. 29, 1997, WO95/04809, WO96/02625, PCT US97/14610 filed Aug. 19, 1997 and claiming priority of Aug. 19, 1996, and EP-A-0,752,465, incorporated herein by reference.

6-Soil Release Agent

Soil Release agents are desirably used in compositions of the instant invention. Any polymeric soil release agent known to those skilled in the art can optionally be employed in the compositions of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

If utilized, soil release agents will generally comprise from about 0.01% to about 10.0%, by weight, of the detergent compositions herein, typically from about 0.1% to about 5%, preferably from about 0.2% to about 3.0%.

The following, all included herein by reference, describe soil release polymers suitable for use in the present invention. U.S. Pat. No. 3,959,230 Hays, issued May 25, 1976; U.S. Pat. No. 3,893,929 Basadur, issued Jul. 8, 1975; U.S. Pat. No. 4,000,093, Nicol, et al., issued Dec. 28, 1976; U.S. Pat. No. 4,702,857 Gosselink, issued Oct. 27, 1987; U.S. Pat. No. 4,968,451, Scheibel et al., issued Nov. 6; U.S. Pat. No. 4,702,857, Gosselink, issued Oct. 27, 1987; U.S. Pat. No. 4,711,730, Gosselink et al., issued Dec. 8, 1987; U.S. Pat. No. 4,721,580, Gosselink, issued Jan. 26, 1988; U.S. Pat. No. 4,877,896, Maldonado et al, issued Oct. 31, 1989; U.S. Pat. No. 4,956,447, Gosselink et al., issued Sep. 11, 1990; U.S. Pat. No. 5,415,807 Gosselink et al, issued May 16, 1995; European Patent Application 0 219 048, published Apr. 22, 1987 by Kud, et al.

Further suitable soil release agents are described in U.S. Pat. No. 4,201,824, Violland et al.; U.S. Pat. No. 4,240,918 Lagasse et al.; U.S. Pat. No. 4,525,524 Tung et al; U.S. Pat. No. 4,579,681, Ruppert et al.; U.S. Pat. No. 4,240,918; U.S. Pat. No. 4,787,989; U.S. Pat. No. 4,525,524; EP 279,134 A, 1988, to Rhone-Poulenc Chemie; EP 457,205 A to BASF (1991); and DE 2,335,044 to Unilever N. V., 1974 all incorporated herein by reference.

Commercially available soil release agents include the METOLOSE SM100, METOLOSE SM200 manufactured by Shin-etsu Kagaku Kogyo K.K., SOKALAN type of material, e.g., SOKALAN HP-22, available from BASF (Germany), ZELCON 5126 (from Dupont) and MILEASE T (from ICI).

7-pH

An optional requirement of the compositions according to the present invention is that the pH is greater than 3, preferably between 3 and 12. This range is preferred for fabric safety. When a lubricant of the diester quaternary ammonium type is used, it is most preferred to have the conventional pH range, as measured in the neat compositions at 20° C., of from 2.0 to 5, preferably in the range of 2.5 to 4.5, preferably about 2.5 to about 3.5. The pH of these compositions herein can be regulated by the addition of a Bronsted acid.

9- Other Optional Ingredients

The present invention can include optional components conventionally used in textile treatment compositions, for example, colorants, preservatives, bactericides, optical brighteners, opacifiers, anti-shrinkage agents, germicides, fungicides, anti-oxidants, dye fixing agent, enzymes, chelating agents, cyclodextrin, metallic salts to absorb amine and sulfur-containing compounds and selected from the group consisting of copper salts, zinc salts, and mixtures thereof, color protectors like polyethylene imine and its alkoxylated derivatives, and the like. The compositions are preferably free of any material that would soil or stain fabric, and are also substantially free of starch. Typically, there should be less than about 0.5%, by weight of the composition, preferably less than about 0.3%, more preferably less than about 0.1%, by weight of the composition, of starch and/or modified starch.

Form of the Composition and Compounds

The composition or its individual components can be provided in any suitable form such as spray, foam, gel or any other suitable form for liquid aqueous compositions.

Method of Use

There is provided a method of treating fabrics, in particular to provide durable press on fabric, i.e. for providing wrinkle resistant fabrics, which comprises the steps of contacting the fabrics with a cross-linking compound or composition of the invention, as defined herein before, and subsequently curing the composition using a domestic process.

By "contacting", it is meant any steps that is suitable for providing a contact of the composition with the fabric. This can include by soaking, washing, rinsing, and/or spraying as well as by means of a dryer sheet onto which is adsorbed the composition. Preferably, the contacting occurs in the step of a laundering process, preferably a rinse step of a laundry process, which more preferably occurs at a temperature range below 30° C., preferably between 5 and 25° C.

Domestic curing of the fabric can be caused by the heat used to dry the fabric, e.g. by tumble drying. Ironing is also particularly advantageous for curing the fabric. Without to be bound by theory, it is believed that the shorter time or the low temperatures used to domestically cure the cross-linking components mean that the fabric is made resistant to wrinkles without changing its tactile, or drape properties.

Still another advantage of the present invention is that when epichlorhydrin adducts of polyamine resins, polyethyleneimine resins, cationic starch, or polydiallyldimethylammonium chloride are used, such as in particular with Kymene compounds, the domestic curing can occur at room temperature, i.e. from 15 to 30° C.

Still a further advantage of the above mentioned epichlorhydrin adducts is their usability in industrial treatment. Accordingly, there is also provided a method for treating fabric which comprises the steps of contacting the fabrics with an epichlorhydrin adduct of polyamine resins, polyethyleneimine resins, cationic starch, or polydiallyidimethylammonium chloride, or mixtures thereof, and thereafter curing the fabrics. In this preferred method, the curing is that which is conventionally known in industrial process like padding.

The composition of the present invention can also be used as an ironing aid. An effective amount of the composition can be sprayed onto fabric, wherein said fabric should not be sprayed to saturation. The fabric can be ironed at the normal temperature at which it should be ironed. Still another preferred way of treating the fabrics is when the fabric can be sprayed with an effective amount of the composition, allowed to dry and then ironed, or sprayed and ironed immediately.

The invention is illustrated in the following non limiting examples, in which all percentages are on a weight basis unless otherwise stated.

In the examples, the abbreviated component identifications have the following meanings:

| | |
|---|---|
| Resin #1 | Polyamide/polyamine/epichlorohydrin resin commercially available under the tradename KYMENE 557 from Hercules Inc. |
| Resin #2 | Polyamide/polyamine/epichlorohydrin resin commercially available under the tradename KYMENE 450 from Hercules Inc. |
| Resin #3 | Melamine-formaldehyde resin commercially available under the tradename CASSURIT HML from Clariant |
| Resin #4 | Poly(acrylamide-glyoxal) resin commercially available under the tradename SOLIDURIT KM from Clariant |
| Resin #5 | Melamine-formaldehyde resin commercially available under the tradename MADURIT MW 167 from Clariant |
| Catalyst | Catalyst NKD, made of a mixture of salts and organic acid, and commercially available from Hoechst |
| DEQA | Di-(tallowyl-oxy-ethyl) dimethyl ammonium chloride |
| DOEQA | Di-(oleyloxyethyl) dimethyl ammonium methylsulfate |
| DTDMAC | Ditallow dimethylammonium chloride |
| Fatty acid | tallow fatty acid IV = 18 |
| Electrolyte | Calcium chloride |
| PEG | Polyethylene Glycol 4000 |
| PEI 1800 E1 | Ethoxylated polyethylene imine (MW 1800, at 50% active) as synthesised in Synthesis example 1 |
| PEI 1200 E7 | Ethoxylated polyethylene imine (MW 1200, at 50% active in water) as synthesised per Synthesis example 2 |
| Dye Fix 1 | Cellulose reactive dye fixing agent available under the tradename Indosol CR from Clariant |

Synthesis Example 1—Preparation of PEI 1800 $E_1$

Step A)—The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide (ARC) is set up to deliver ethylene oxide as a liquid by a pump to the autoclave with the cylinder placed on a scale so that the weight change of the cylinder could be monitored.

A 750 g portion of polyethyleneimine (PEI) (Nippon Shokubai, Epomin SP-018 having a listed average molecular weight of 1800 equating to 0.417 moles of polymer and 17.4 moles of nitrogen functions) is added to the autoclave. The autoclave is then sealed and purged of air (by applying vacuum to minus 28" Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100 and 110° C. while the total pressure is allowed to gradually increase during the course of the reaction. After a total of 750 grams of ethylene oxide has been charged to the autoclave (roughly equivalent to one mole ethylene oxide per PEI nitrogen function), the temperature is increased to 110° C. and the autoclave is allowed to stir for an additional hour. At this point, vacuum is applied to remove any residual unreacted ethylene oxide.

Step B)—The reaction mixture is then deodorized by passing about 100 cu. ft. of inert gas (argon or nitrogen) through a gas dispersion frit and through the reaction mixture while agitating and heating the mixture to 130° C. The final reaction product is cooled slightly and collected in glass containers purged with nitrogen. In other preparations the neutralization and deodorization is accomplished in the reactor before discharging the product.

Synthesis Example 2—Preparation of PEI 1200 $E_1$

Step A)—The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide (ARC) is set up to deliver ethylene oxide as a liquid by a pump to the autoclave with the cylinder placed on a scale so that the weight change of the cylinder could be monitored.

A 750 g portion of polyethyleneimine (PEI) ( having a listed average molecular weight of 1200 equating to about 0.625 moles of polymer and 17.4 moles of nitrogen functions) is added to the autoclave. The autoclave is then sealed and purged of air (by applying vacuum to minus 28" Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and thylene oxide flow rate. The ethylene oxide pump is turned off and cooling is applied to limit any temperature increase resulting from any reaction exotherm. The temperature is maintained between 100 and 110° C. while the total pressure is allowed to gradually increase during the course of the reaction. After a total of 750 grams of ethylene oxide has been charged to the autoclave (roughly equivalent to one mole ethylene oxide per PEI nitrogen function), the temperature is increased to 110° C. and the autoclave is allowed to stir for an additional hour. At this point, vacuum is applied to remove any residual unreacted ethylene oxide.

Step B)—The reaction mixture is then deodorized by passing about 100 cu. ft. of inert gas (argon or nitrogen) through a gas dispersion frit and through the reaction mixture while agitating and heating the mixture to 130° C. The final reaction product is cooled slightly and collected in glass containers purged with nitrogen.

In other preparations the neutralization and deodorization is accomplished in the reactor before discharging the product.

If a PEI 1200 $E_7$ is desired, the following step of catalyst addition will be included between Step A and B.

Vacuum is continuously applied while the autoclave is cooled to about 50° C. while introducing 376 g of a 25% sodium methoxide in methanol solution (1.74 moles, to achieve a 10% catalyst loading based upon PEI nitrogen functions). The methoxide solution is sucked into the autoclave under vacuum and then the autoclave temperature controller setpoint is increased to 130° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1 hour indicating that most of the methanol has been removed. The mixture is further heated and agitated under vacuum for an additional 30 minutes.

Vacuum is removed and the autoclave is cooled to 105° C. while it is being charged with nitrogen to 250 psia and then vented to ambient pressure. The autoclave is charged to 200 psia with nitrogen, Ethylene oxide is again added to the autoclave incrementally as before while closely monitoring the autoclave pressure, temperature, and ethylene oxide flow rate while maintaining the temperature between 100 and 110° C. and limiting any temperature increases due to reaction exotherm. After the addition of 4500 g of ethylene oxide (resulting in a total of 7 moles of ethylene oxide per mole of PEI nitrogen function) is achieved over several hours, the temperature is increased to 110° C. and the mixture stirred for an additional hour.

The reaction mixture is then collected in nitrogen purged containers and eventually transferred into a 22 L three neck round bottomed flask equipped with heating and agitation. The strong alkali catalyst is neutralized by adding 167 g methane sulfonic acid (1.74 moles).

Other preferred examples such as PEI 1200 E2, PEI 1200 E3, PEI 1200 E15 and PEI 1200 E20 can be prepared by the above method by adjusting the reaction time and the relative amount of ethylene oxide used in the reaction.

The invention is illustrated in the following non limiting examples, in which all percentages are on a weight basis unless otherwise stated.

EXAMPLE

The following compositions A to J are in accordance with the invention.

| | A | B | C | D | E | F | G | H | I | J |
|---|---|---|---|---|---|---|---|---|---|---|
| Resin #1 | 15 | — | — | — | — | — | — | — | — | 12 |
| Resin #2 | — | 25 | — | — | — | — | — | — | 15 | — |
| Resin #3 | — | — | 50 | 50 | 50 | 10 | — | — | — | — |
| Resin #4 | — | — | — | — | — | — | 30 | — | — | — |
| Resin #5 | — | — | — | — | — | — | — | 30 | 30 | 30 |
| DEQA | — | — | 5 | — | 5 | 1 | — | 5 | 5 | 5 |
| DOEQA | — | 5 | — | — | — | — | 5 | — | — | — |
| DTDMAC | 10 | — | — | — | — | — | — | — | — | — |
| Fatty acid | — | — | — | — | — | 2 | — | — | — | — |
| Electrolyte | — | — | — | — | — | — | — | — | — | 2 |
| PEG | — | — | — | 3 | — | — | — | — | 2 | — |
| PEI 1800 E1 | — | — | — | — | — | — | — | 10 | — | — |
| PEI 1200 E7 | — | — | — | — | 5 | — | — | — | 5 | — |
| Dye Fix 1 | — | — | — | — | 5 | — | — | — | 5 | 3 |
| Catalyst | — | — | 20 | — | 20 | 3 | 10 | 10 | — | — |
| water and minors to balance to 100% | | | | | | | | | | |

What is claimed is:

1. A composition comprising:

i)—a fabric softening compound;

ii)—a polymer system consisting of a polymer comprising a cross-linking resin having the property of being cationic wherein the cross-linking resin comprises an amine-aldehyde moiety; and iii)—a soil release agent.

2. A composition according to claim 1, wherein said cross-linking resin has a molecular weight between 500 and 100,000.

3. A composition according to claim 2, wherein said cross-linking resin has a molecular weight between 500 and 100,000.

4. A composition according to claim 1, wherein said cross-linking resin is present in an amount of from 0.01% to 60 by weight of the total composition.

5. A composition according to claim 1, wherein said composition further comprises a catalyst.

6. A composition according to claim 5, wherein said catalyst is present in an amount of from 10% to 50%, by weight of the cross-linking components or derivative thereof.

7. A composition according to claim 1, wherein the softening compound is a quaternary ammonium compounds or amine precursors thereof.

8. A method of treating fabrics which comprises the steps of:

i)—contacting the fabrics with a composition according to claim 1; and ii)—curing the composition present on the fabrics by exposing the composition to heat.

9. The method according to claim 8 wherein the heat is provided during operation of a tumble dryer in which the fabrics are present.

10. The method according to claim 8 wherein the heat is provided by an iron during ironing of the fabrics.

* * * * *

UNITED STATES PATENT AND TRADEMARK OFFICE

CERTIFICATE OF CORRECTION

PATENT NO. : 6,514,932 B1 
DATED : February 4, 2003
INVENTOR(S) : Bruno Alfred Jean Hubesch et al.

It is certified that error appears in the above-identified patent and that said Letters Patent is hereby corrected as shown below:

Column 21,
Line 11, please replace "500" with -- 200 --.
Line 12, please replace "100,000" with -- 1,000,000 --.

Signed and Sealed this

Eighth Day of July, 2003

JAMES E. ROGAN
*Director of the United States Patent and Trademark Office*